US010375999B2

(12) United States Patent
Roup

(10) Patent No.: US 10,375,999 B2
(45) **Date of Patent: *Aug. 13, 2019**

(54) EXPANDABLE AND FLEXIBLE SHIRT COLLAR STAND AND SHIRT WITH SAME

(71) Applicant: Talon Technologies, Inc., Woodland Hills, CA (US)

(72) Inventor: Herman Sydney Roup, Santa Barbara, CA (US)

(73) Assignee: TALON TECHNOLOGIES, INC., Woodland Hills, CA (US)

( * ) Notice: Subject to any disclaimer, the term of this patent is extended or adjusted under 35 U.S.C. 154(b) by 2 days.

This patent is subject to a terminal disclaimer.

(21) Appl. No.: 15/877,326

(22) Filed: Jan. 22, 2018

(65) Prior Publication Data

US 2018/0140022 A1 May 24, 2018

Related U.S. Application Data

(63) Continuation of application No. 15/698,463, filed on Sep. 7, 2017, now Pat. No. 9,872,522, and a continuation of application No. PCT/US2017/016090, filed on Feb. 1, 2017, and a continuation of application No. 15/250,688, filed on Aug. 29, 2016, now Pat. No. 9,756,879.

(60) Provisional application No. 62/301,075, filed on Feb. 29, 2016.

(51) Int. Cl.

| | |
|---|---|
| ***A41B 3/00*** | (2006.01) |
| ***A41B 1/12*** | (2006.01) |
| ***A41B 1/16*** | (2006.01) |

(52) U.S. Cl.
CPC ..... *A41B 3/00* (2013.01); *A41B 1/12* (2013.01); *A41B 1/16* (2013.01)

(58) Field of Classification Search
CPC ..... A41B 3/00
USPC ..... 2/116
See application file for complete search history.

(56) References Cited

U.S. PATENT DOCUMENTS

| | | | |
|---|---|---|---|
| 1,579,879 | A | 4/1926 | Margulies |
| 1,640,805 | A | 8/1927 | Rabell |
| 1,645,946 | A | 10/1927 | Currea |
| 1,776,975 | A | 9/1930 | Levy |

(Continued)

FOREIGN PATENT DOCUMENTS

| | | | |
|---|---|---|---|
| CA | 2238598 | | 1/2007 |
| DE | 2022108 | A1 | 11/1971 |

(Continued)

OTHER PUBLICATIONS

WIPO, Written Opinion of the International Searching Authority, PCT/US2017/016090, (International Search Authority, Israel Patent Office) dated May 10, 2017.

(Continued)

*Primary Examiner* — Katherine M Moran
(74) *Attorney, Agent, or Firm* — Siritzky Law, PLLC; Brian Siritzky

(57) ABSTRACT

A shirt has a collar stand attached to a shirt body. The collar stand comprises an inner piece and an outer piece, wherein at least one of the inner piece and the outer piece is formed from a self-fabric combined with a second material, and wherein the collar stand has stretch and recovery in at least two directions thereof.

28 Claims, 3 Drawing Sheets

© Talon Technologies, Inc. All Rights Reserved. Proprietary and Confidential until published as patent application or issued patent.

(56) References Cited

U.S. PATENT DOCUMENTS

| | | | | | |
|---|---|---|---|---|---|
| 1,963,004 | A * | 6/1934 | Tucker | A41B 3/02 | 2/127 |
| 2,025,485 | A | 12/1935 | Tucker | | |
| 2,033,680 | A | 3/1936 | Campbell | | |
| 2,087,532 | A | 7/1937 | Shepherd | | |
| 2,101,380 | A | 12/1937 | Alston | | |
| 2,264,224 | A | 11/1941 | Swan | | |
| 2,396,842 | A | 3/1946 | Franklin | | |
| 2,435,509 | A | 2/1948 | Pfeffer, Jr. | | |
| 2,601,035 | A | 6/1952 | Liebowitz | | |
| 2,903,702 | A | 9/1959 | Ainslie | | |
| 2,996,723 | A | 8/1961 | Ainslie | | |
| 3,024,467 | A | 3/1962 | Sommer | | |
| 3,121,233 | A | 2/1964 | Rothman | | |
| 3,148,377 | A | 9/1964 | Anderson | | |
| 3,237,207 | A | 3/1966 | Ainslie | | |
| 3,289,213 | A * | 12/1966 | Backstrom | A41B 3/06 | 2/116 |
| 3,328,808 | A | 7/1967 | Ambrose | | |
| 3,333,280 | A | 8/1967 | Hynek | | |
| 3,430,264 | A | 3/1969 | Beukenkamp | | |
| 3,446,658 | A | 5/1969 | Rose | | |
| 3,629,866 | A | 12/1971 | Blue | | |
| 3,642,561 | A | 2/1972 | Grobner | | |
| 3,693,191 | A | 9/1972 | Dowsett | | |
| 3,831,200 | A * | 8/1974 | Weiss | A41B 3/00 | 2/143 |
| 3,842,435 | A | 10/1974 | Williams et al. | | |
| 3,922,418 | A | 11/1975 | Lauchenauer | | |
| 3,937,859 | A | 2/1976 | Carra et al. | | |
| 4,143,424 | A | 3/1979 | Knoke et al. | | |
| 4,333,980 | A * | 6/1982 | Russell | A41B 3/10 | 428/192 |
| 4,450,196 | A * | 5/1984 | Kamat | A41D 27/06 | 156/148 |
| 4,670,908 | A | 6/1987 | Albert | | |
| 4,847,919 | A | 7/1989 | Hwang | | |
| 4,937,883 | A | 7/1990 | Shirai | | |
| 4,937,884 | A | 7/1990 | Sherman | | |
| 4,989,269 | A | 2/1991 | Takasugi | | |
| 5,274,853 | A | 1/1994 | Millican | | |
| 5,651,140 | A | 7/1997 | Gibson | | |
| 5,848,439 | A | 12/1998 | Huseth | | |
| 6,212,686 | B1 | 4/2001 | Krause et al. | | |
| 7,146,647 | B2 | 12/2006 | Krause | | |
| 8,065,747 | B2 | 11/2011 | Keeter | | |
| 9,066,549 | B2 | 6/2015 | Morris | | |
| 9,756,879 | B2 * | 9/2017 | Roup | A41B 3/00 | |
| 9,854,849 | B2 | 1/2018 | Tesser et al. | | |
| 2002/0120974 | A1 | 9/2002 | Krause et al. | | |
| 2005/0160520 | A1 | 7/2005 | Forrest | | |
| 2006/0040575 | A1 | 2/2006 | Kelleher | | |
| 2010/0263105 | A1 * | 10/2010 | Pilarski | A41B 3/005 | 2/116 |
| 2012/0151660 | A1 | 6/2012 | Savenok | | |
| 2015/0113697 | A1 | 4/2015 | Roup | | |

FOREIGN PATENT DOCUMENTS

| | | | |
|---|---|---|---|
| GB | 454417 | A | 9/1936 |
| GB | 521805 | | 5/1940 |
| GB | 829510 | | 3/1960 |
| GB | 870850 | | 6/1961 |
| JP | 1999043812 | A | 5/1998 |
| JP | 2008510893 | A | 10/2008 |
| JP | 2013040416 | A | 2/2013 |
| KR | 19980059435 | U | 10/1998 |
| KR | 200320617 | Y1 | 4/2003 |
| KR | 200320617 | | 7/2003 |
| KR | 100895889 | B1 | 8/2007 |
| WO | 9428227 | A1 | 12/1994 |

OTHER PUBLICATIONS

WIPO, International Search Report, PCT/US2017/016090, (International Search Authority, Israel Patent Office) dated May 10, 2017.
Prior Art Search Report (submitted to Korean Intellectual Property Office (KIPO) in KR 10-2018-7026543 for Expedited Examination), dated Sep. 2018, Report by WIPS, in Korean with English language translation.
Abstract of JP2013040416 A (machine translation).
Abstract of JP1999043812 A (machine translation).
Abstract of KR200320617 Y1 (machine translation).
Abstract of KR100895889 B1 (machine translation).
Abstract of JP2008510893 A (machine translation).
Notice of Reasons for Rejection, Japanese Patent Application No. 2018-541253, dated Jan. 8, 2019, Japanese Patent Office (JPO) [in Japanese].
Notice of Reasons for Rejection, Japanese Patent Application No. 2018-541253, dated Jan. 8, 2019, Japanese Patent Office (JPO) [English language translation].
Notice of Reasons for Rejection, Japanese Patent Application No. 2018-541253, dated Jan. 8, 2019, Japanese Patent Office (JPO) [English language translation, human translator].
Notice of Preliminary Rejection (Non-Final) from the Korean Intellectual Property Office (KIPO) in KR 10-2018-7026543 (in Korean with English translation), dated Dec. 17, 2018.
KR200320617A (machine translation).
EPO, Extended European Search Report, dated Apr. 12, 2019 for EP 17760447.7 [11 pages].
English translation of DE 2022108 A1, Nov. 18, 1971, Hamar Waeschefabrik Unglaub KG.
Office Action issued by China National Intellectual Property Administration dated Apr. 10, 2019 for Chinese patent application No. 201780013910.5, including partial English translation.

* cited by examiner

© Talon Technologies, Inc. All Rights Reserved. Proprietary and Confidential until published as patent application or issued patent.

© Talon Technologies, Inc. All Rights Reserved. Proprietary and Confidential until published as patent application or issued patent.

© Talon Technologies, Inc. All Rights Reserved. Proprietary and Confidential until published as patent application or issued patent.

EXPANDABLE AND FLEXIBLE SHIRT COLLAR STAND AND SHIRT WITH SAME

RELATED APPLICATION

This application is a continuation of U.S. patent application Ser. No. 15/698,463 filed Sep. 7, 2017, which is a continuation of U.S. patent application Ser. No. 15/250,688, filed Aug. 29, 2016 and titled "Expandable and Flexible Shirt Collar Stand and Shirt with Same," which claims the benefit of U.S. Provisional Application No. 62/301,075, filed Feb. 29, 2016, the entire contents of each of which are hereby fully incorporated herein by reference for all purposes.

This application is also a continuation of PCT/US2017/16090 filed on Feb. 1, 2017, which also claims the benefit of U.S. Provisional Application No. 62/301,075.

COPYRIGHT STATEMENT

This patent document contains material subject to copyright protection. The copyright owner has no objection to the reproduction of this patent document or any related materials in the files of the United States Patent and Trademark Office, but otherwise reserves all copyrights whatsoever.

BACKGROUND OF THE INVENTION

Field of the Invention

This invention relates to garments and garment manufacture. More particularly, this invention relates to shirts and expandable shirt collars.

Background and Overview

Shirts, especially men's dress shirts, are typically sized based on collar circumference and sleeve length. Some shirts, especially men's dress shirts are generally sized to be worn with the collar closed (e.g., buttoned), and so any shrinkage in the collar will adversely affect the wearer. Unfortunately the fabrics used for most dress shirts is subject to shrinkage from laundering, and so most dress shirts may become difficult or uncomfortable to wear after multiple washes. In addition, the wearer of a shirt may gain weight, thereby increasing their neck size and making their dress shirts difficult to close at the neck.

It is desirable to provide a shirt collar stand that expands, as needed, while keeping its shape, and for it to return to its original length. It is further desirable to provide a shirt collar stand with little or no shrinkage. It is also desirable to provide a shirt collar stand that flexes when worn to eliminate the puckering where it joins the back yoke. It is further desirable to provide a shirt with such a collar stand.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE PRESENTLY PREFERRED EXEMPLARY EMBODIMENTS

Figure 1:
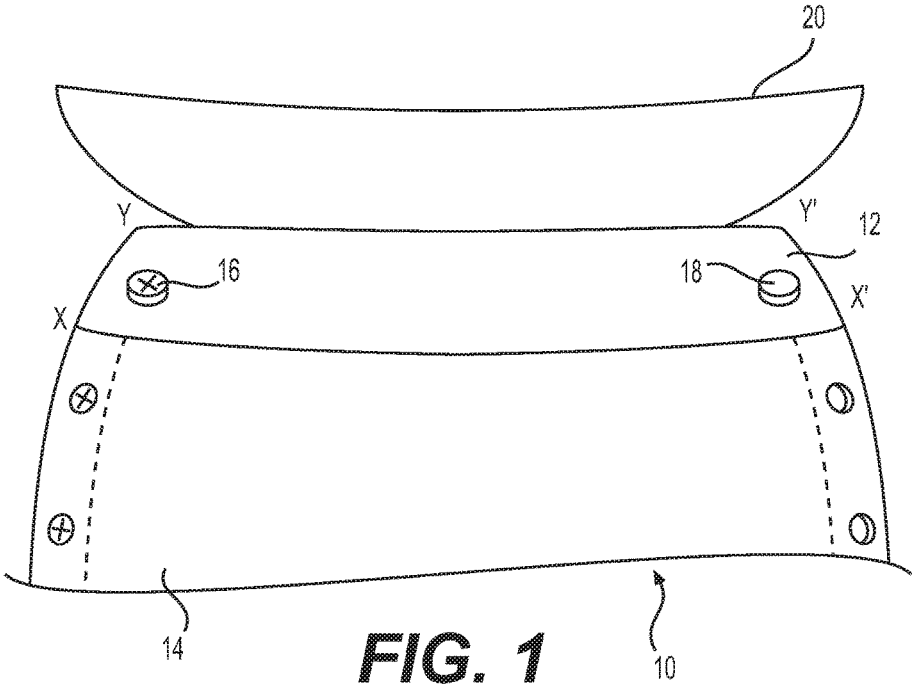
FIG. 1 depicts aspects of a shirt collar according to exemplary embodiments hereof.
Figure 2:
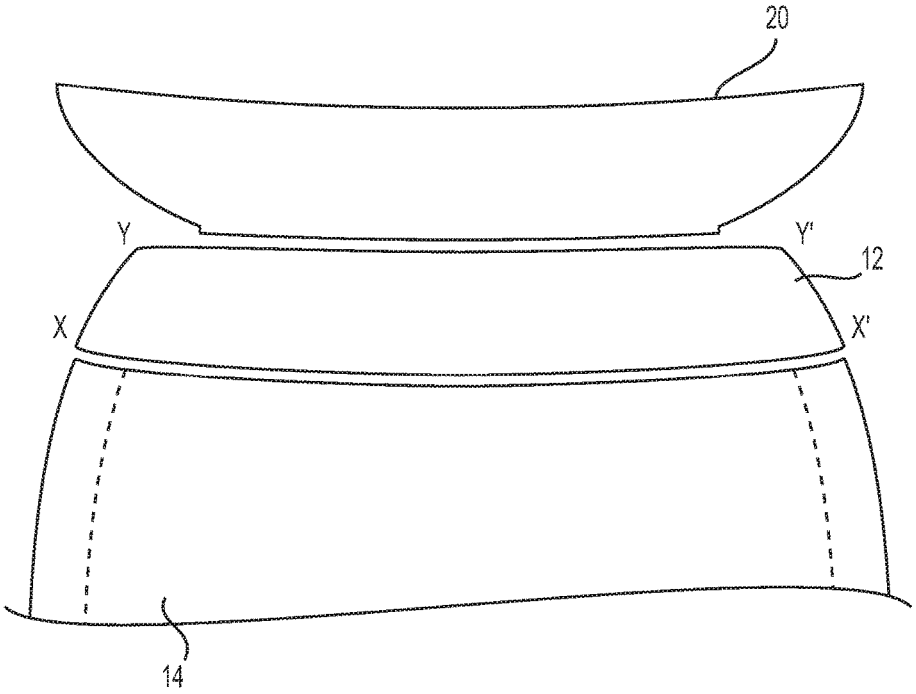
FIG. 2 depicts an exploded view of aspects of the shirt collar of FIG. 1.

FIG. 1 shows a shirt 10 incorporating a collar according to exemplary embodiments hereof. A collar stand 12 is attached to the body of the shirt body 14, e.g., by being sewn along the line X-X'. The collar stand 12 may have a button 16 on one end thereof, and a buttonhole 18 on the other end, and typically defines the shirt's neck size. A collar 20 is attached to the collar stand 12, e.g., by inserting a substantially rigid portion of the collar 20 into the collar stand 12, and sewing along the line Y-Y'. FIG. 2 depicts an exploded view of aspects of the shirt collar of FIG. 1.

Figure 3:
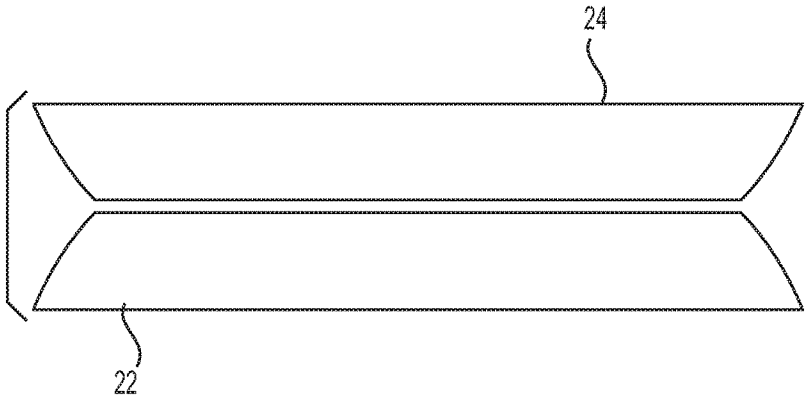
FIG. 3 depicts aspects of a collar stand according to exemplary embodiments hereof.

With reference now to FIG. 3, a collar stand 12 according to exemplary embodiments hereof, is formed from two substantially matching pieces, an inner piece 22, and an outer piece 24. The inner piece 22 is positioned to be on the inside of the shirt 10, when worn, while the outer piece 24 is positioned to be on the outside of the shirt 10, when worn. The inner and outer pieces 22, 24, are overlaid to form the collar stand 12. The collar stand 12 preferably curves around the neck when attached to a shirt and worn.

For the purposes of this description, the length of the collar stand 12 is the horizontal dimension in the drawings, and the width of the collar stand is the vertical dimension. A collar stand need not have the same width across its length (i.e., it may be wider at some points than at others). Similarly, a collar stand need not have the same length across its width (i.e., it may be longer at some points than at others). For example, with reference to FIG. 1, the length Y-Y' need not be the same as the length X-X'. As is generally understood, the length of the collar stand 12 is the longer dimension, its width being the shorter dimension.

The inner and outer pieces 22, 24 of the collar stand 12 may each be formed by fusing together a self-fabric with a two-way fusible substrate. A two-way fusible substrate is a fusible substrate that provides stretch and recovery in two directions, typically, but not necessarily, vertical to each other. In preferred embodiments the two-way fusible substrate has greater stretch in the horizontal or length direction thereof, preferably about 90% horizontal stretch, with the other direction of stretch being about 10%.

The self-fabric used to form the inner and outer pieces 22, 24 may be any general shirting fabric, including cotton, poly-cotton, linen, etc. The self-fabric may, but need not be, the same fabric as the shirt.

The self-fabric used to form the pieces 22, 24 may be cut in any way, including, e.g., along its length, breadth, or on a bias.

The self-fabric used to form the pieces 22, 24 may initially be with or without stretch (e.g., a compacted woven or compacted knit material).

In some embodiments, the pieces of the collar stand (i.e., the inner and outer pieces 22, 24) may be formed by first compacting the underlying self-fabric to give it stretch properties, and then combining the compacted underlying self-fabric with the two-way fusible substrate (to control and give memory to the stretch imposed by the compaction). As should be appreciated, the underlying self-fabric has the capacity to extend, and that the extension and recovery is affected by the fusible substrate.

Figure 4:
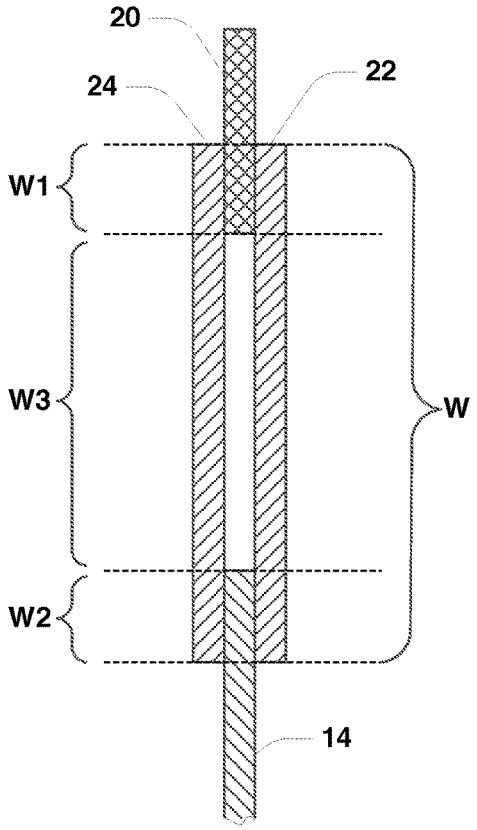
FIG. 4 is a side view of the shirt collar attached to a shirt using the collar stand according to exemplary embodiments hereof.

FIG. 4 shows a side view of the shirt collar 20 attached to a shirt body 14 using the collar stand 24, according to exemplary embodiments hereof As noted above, the bottom of the collar stand 12 is attached to the shirt body 14, e.g., along the line X-X' (FIGS. 1-2). The top of the collar stand 12 is attached to the collar 20, e.g., by being sewn along the line Y-Y' (FIGS. 1-2).

With reference to FIGS. 2 and 4, to connect the collar 20 to the collar stand 12, a lower and substantially rigid portion of the collar 20 is positioned between the inner and outer pieces 22, 24 of the collar stand 12 and the pieces are connected (e.g., stitched together). The width (W1) of the lower portion of the collar 20 that is positioned between the inner and outer pieces 22, 24 of the collar stand 12 is preferably about ⅛ inch to ¼ inch.

The inner and outer pieces 22, 24 of the collar stand 12 are preferably formed from fabric having stretch and recovery in two directions. Preferably, the collar stand 12 has stretch and recovery in a substantially horizontal direction, substantially parallel to the bottom of the collar stand, thereby to the top of the shirt. The collar stand also preferably has stretch and recovery in a substantially vertical direction, substantially vertical to the bottom of the collar stand, thereby to the top of the shirt.

To attach the collar stand 12 to the shirt body 14, a top portion of the shirt body 14 is positioned between the inner and outer pieces 22, 24 of the collar stand 12 and the pieces are stitched together. The width (W2) of the shirt portion of the collar 20 that is positioned between the inner and outer pieces of the collar stand is preferably about ⅛ inch to ¼ inch.

It should be appreciated that the width W1 should be sufficient to maintain the collar 20 in the collar stand 12 without taking up too much space in the collar stand 12. Similarly, the width W2 should be sufficient to maintain the collar stand 12 connected to the shirt body, also without taking up too much space in the collar stand 12.

Figure 5:
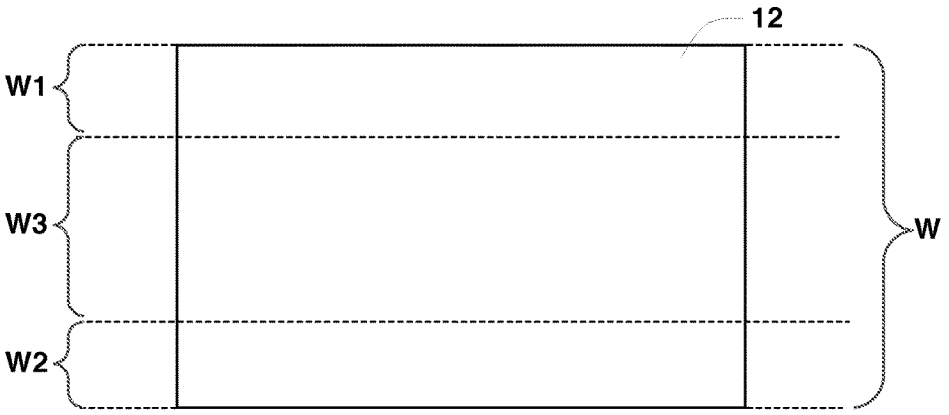
FIG. 5 depicts aspects of a shirt collar attached to a shirt using the collar stand according to exemplary embodiments hereof.

With reference to FIG. 5, the width W3 of the portion of the collar stand 12 that does not cover either a portion of the collar 20 or a portion of the shirt 14 is preferably at least 80% of the total width of the collar stand 12, at least for a substantial length of the collar stand 12. Those of ordinary skill in the art will realize and appreciate, upon reading this description, that if the portions of the collar and shirt that are within the collar stand 12 are too large, then the collar stand will lose some of its stretch and/or recovery properties. In some preferred embodiments hereof the width W3 averages between 50% and 95% of the total width (W) of the collar stand 12. In other words, the sum of the widths W1 and W2 averages between 5% and 50% of the total width (W) of the collar stand 12. That is, preferably W1+W2 is between 5% and 50% of W along the length of the collar stand 12. For example, an exemplary collar stand has a total width of about 1¼ inches (W), the width (W1) of the lower portion of the collar is about ¼ inch, and the width (W2) of the shirt portion is also about ¼ inch. In this example, the width (W3) is about ¾ inch or 60% of the total width (W) of the collar stand.

As noted, the inner and outer pieces 22, 24 of the collar stand 12 are not necessarily parallel, and so the widths W1 and W2, and the width W3 may not be the same across the entire collar stand 12.

As noted, in preferred embodiments hereof, the collar 20, or at least the lower portion of the collar 20 that is attached to the collar stand 12, is substantially rigid. In some preferred embodiments, e.g., for dress shirts and the like, the entire collar 20 is substantially rigid. The shirt body is generally not rigid, and therefore the bottom of the collar stand 12 can grow/expand larger than the top. A collar stand that is about 15% compacted will match the stretch of the attached shirt and may also match the stretch of a stretch shirt.

The combined collar and collar stand described herein provides numerous advantages over prior approaches. Since the collar stand has been compacted, it will not shrink as much as a non-compacted collar. However, when the collar stand does expand, it will return substantially to its original length.

As described above, the collar stand 12 is connected to the shirt body 14. As understood by those of ordinary skill in the art, the collar stand 12 is connected to different parts of the shirt body 14. In the back of the shirt, the collar stand 12 is typically connected to the shirt's yoke or to a back panel of the shirt. The collar stand described herein reduces puckering at the connection of the collar stand to the shirt.

This puckering usually happens as a result of shrinkage in opposite directions or stretch in opposite directions giving an uneven appearance after washing, or by incorrect sewing tension used when joining the collar stand to the shirt (e.g., to the shirt's yoke).

With the collar stand being able to move in two directions, it enables the collar stand to remain flat or greatly reduce the puckering that normally occurs, especially when the fabric has to curve all around the neck.

Thus is described a shirt collar stand that expands, as needed, while keeping its shape, and which returns substantially to its original length. The described shirt collar stand has little or no shrinkage, and flexes when worn to eliminate puckering where it joins the back yoke of the shirt.

Where a process is described herein, those of ordinary skill in the art will appreciate that the process may operate without any user intervention. In another embodiment, the process includes some human intervention (e.g., a step is performed by or with the assistance of a human).

As used in this description, the term "portion" means some or all. So, for example, "A portion of P" may include some of "P" or all of "P". In the context of a conversation, the term "portion" means some or all of the conversation.

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, the phrase "using" means "using at least," and is not exclusive. Thus, e.g., the phrase "using Z" means "using at least Z." Unless specifically stated by use of the word "only", the phrase "using Z" does not mean "using only Z."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means "X is at least partially distinct from Y," and does not mean "X is fully distinct from Y." Thus, as used herein, including in the claims, the phrase "X is distinct from Y" means that X differs from Y in at least some way.

It should be appreciated that the words "first" and "second" in the description and claims are used to distinguish or identify, and not to show a serial or numerical limitation. Similarly, the use of letter or numerical labels (such as "(a)", "(b)", and the like) are used to help distinguish and/or identify, and not to show any serial or numerical limitation or ordering.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

I claim:

1. A shirt comprising:

a collar stand comprising an inner piece and an outer piece, wherein at least one of the inner piece and the outer piece is formed from a self-fabric fused with a fusible substrate, wherein the self-fabric comprises a shirting fabric with stretch properties, and wherein the collar stand has stretch and recovery properties in at least two non-laterally opposing directions thereof, and wherein at least some recovery properties of the collar stand are provided by the fusible substrate.

2. The shirt of claim 1, wherein the self-fabric for at least one of the inner piece and the outer piece is cut on a bias of the self-fabric.

3. The shirt of claim 2, wherein the self-fabric for both the inner piece and the outer piece is cut on a bias of the self-fabric.

4. The shirt of claim 1, wherein both the inner piece and the outer piece are formed from said self-fabric combined with said fusible substrate.

5. The shirt of claim 1, wherein the fusible substrate provides greater stretch in one of said at least two non-laterally-opposing directions than in other of said non-laterally-opposing directions.

6. The shirt of claim 1, wherein the shirt comprises a shirting fabric, and wherein the self-fabric is the same shirting fabric as the shirt's shirting fabric.

7. The shirt of claim 1, wherein the self-fabric is selected from: cotton, poly-cotton, linen, a compacted woven material, and a compacted knit material.

8. The shirt of claim 1, wherein the fusible substrate comprises a two-way fusible substrate.

9. The shirt of claim 1, wherein said collar stand is attached to a collar.

10. The shirt of claim 9, wherein said collar stand is attached to a rigid portion of said collar.

11. The shirt of claim 9, wherein the collar is rigid.

12. The shirt of claim 9, wherein less than the entire collar is rigid.

13. The shirt of claim 9, wherein at least a portion of said collar is sewn between said inner piece and said outer piece of said collar stand along a length dimension of said collar stand.

14. The shirt of claim 1, wherein said collar stand is attached to a shirt body, and wherein at least a portion of said shirt body is sewn between said inner piece and said outer piece of said collar stand along a length dimension of said collar stand.

15. The shirt of claim 1, wherein said fusible substrate, combined with said self-fabric to form said at least one of the inner piece and the outer piece, controls stretch of said at least one of the inner piece and the outer piece.

16. The shirt of claim 1, wherein said fusible substrate gives memory to said collar stand.

17. The shirt of claim 1, wherein said self-fabric has said stretch properties from prior compaction, and wherein said fusible substrate controls said stretch properties of said self-fabric.

18. The shirt of claim 1, wherein the self-fabric used for the at least one of the inner piece and the outer piece has stretch imposed by prior compaction, and wherein the fusible substrate combined with the at least one of the inner piece and the outer piece controls the stretch imposed by said prior compaction.

19. A shirt comprising:

a collar stand attached to a shirt body, wherein said collar stand comprises an inner piece and an outer piece, and wherein at least one of the inner piece and the outer piece is formed from a self-fabric fused with a fusible substrate, and wherein the self-fabric comprises a shirting fabric with stretch, and wherein the self-fabric is selected from: cotton, poly-cotton, linen, a compacted woven material, and a compacted knit material, wherein the collar stand has stretch and recovery properties in at least two non-laterally-opposing directions thereof, and wherein the collar stand has greater stretch in one of said at least two non-laterally-opposing directions than in other of said non-laterally-opposing directions, and wherein said fusible substrate has stretch, and wherein at least a portion of said shirt body is sewn between said inner piece and said outer piece of said collar stand along a length dimension of said collar stand, and wherein at least some recovery properties of the collar stand are provided by the fusible substrate.

20. The shirt of claim 19, wherein the fusible substrate comprises a two-way fusible substrate.

21. The shirt of claim 19, wherein said self-fabric used for said at least one of the inner piece and the outer piece is cut on a bias of the self-fabric.

22. The shirt of claim 19, wherein said fusible substrate gives memory to said collar stand.

23. A shirt comprising:

a shirt body; and a collar stand attached to the shirt body, wherein said collar stand comprises an inner piece and an outer piece, and wherein at least one of the inner piece and the outer piece is formed from a self-fabric fused with a fusible substrate, and wherein the self-fabric has stretch and is selected from: cotton, poly-cotton, linen, a compacted woven, and a compacted knit material, and wherein the collar stand has stretch and recovery properties in at least two non-laterally-opposing directions thereof, and wherein said fusible substrate controls stretch and recovery properties of said collar stand, and wherein at least a portion of said shirt body is sewn between said inner piece and said outer piece of said collar stand along a length dimension of said collar stand.

24. The shirt of claim 23, wherein the fusible substrate comprises a two-way fusible substrate.

25. The shirt of claim 23, wherein the self-fabric for at least one of the inner piece and the outer piece is cut on a bias of the self-fabric.

26. The shirt of claim 23, wherein said fusible substrate gives memory to said collar stand.

27. The shirt of claim 23, wherein the inner piece is formed from said self-fabric fused with a fusible substrate; and the outer piece is formed from said self-fabric fused with a fusible substrate.

28. A shirt comprising:

a collar stand comprising an inner piece and an outer piece, wherein at least one of the inner piece and the outer piece is formed from a self-fabric having stretch and fused with a fusible substrate, wherein the collar stand has stretch and recovery properties in at least two non-laterally opposing directions thereof, and wherein at least some recovery properties of the collar stand are provided by the fusible substrate, and wherein the self-fabric used for the at least one of the inner piece and the outer piece has stretch imposed by prior compaction, and wherein said fusible substrate gives memory to said collar stand.

* * * * *